US005568693A

United States Patent [19]

Van den Bergen et al.

[11] Patent Number: 5,568,693

[45] Date of Patent: Oct. 29, 1996

[54] METHOD AND AN APPARATUS FOR THE PROCESSING OF PHOTOGRAPHIC SHEET MATERIAL

[75] Inventors: Patrick Van den Bergen, Berchem; Frans Joos, Puurs; Marc De Niel, Antwerpen; Bartholomeus Verlinden, Tongeren, all of Belgium

[73] Assignee: Agfa-Gevaert N.V., Mortsel, Belgium

[21] Appl. No.: 517,467

[22] Filed: Aug. 21, 1995

[30] Foreign Application Priority Data

Sep. 5, 1994 [EP] European Pat. Off. ..... 94202533

[51] Int. Cl.[6] ..... F26B 9/00

[52] U.S. Cl. ..... 34/620; 34/629; 34/636

[58] Field of Search ..... 34/620, 629, 636, 34/618, 619, 620, 662, 451, 475, 477

[56] References Cited

U.S. PATENT DOCUMENTS

| | | | |
|---|---|---|---|
| 4,133,636 | 1/1979 | Flynn | 34/636 |
| 4,316,663 | 2/1982 | Fischer | 34/636 |
| 5,038,495 | 8/1991 | Jacobs et al. | 34/636 |

FOREIGN PATENT DOCUMENTS

| | | | |
|---|---|---|---|
| 3280048 | 12/1991 | Japan | 34/636 |
| 4067145 | 3/1992 | Japan | 34/636 |
| 6083021 | 3/1994 | Japan | 34/620 |

*Primary Examiner*—Edward K. Look
*Assistant Examiner*—Mark Sgantzos
*Attorney, Agent, or Firm*—Brumbaugh, Graves, Donohue & Raymond

[57] ABSTRACT

An apparatus for the processing of photographic sheet material having upstream and downstream drying chambers (101, 102). A heater (106) heats air entering the downstream chamber (102) to a downstream drying temperature. A fan (108) recirculates drying air from the downstream chamber (102) through the heater (106) while taking in fresh air through an inlet (116). A heater (110) heats air entering the upstream chamber (101) to a temperature higher than the downstream drying temperature. A fan (112) recirculates air from the upstream chamber (101) through the heater (110) while taking in air from the downstream chamber (102). Optimum drying of the sheet material is thereby achieved without risk of dimensional instability.

8 Claims, 2 Drawing Sheets

METHOD AND AN APPARATUS FOR THE PROCESSING OF PHOTOGRAPHIC SHEET MATERIAL

BACKGROUND OF THE INVENTION

FIELD OF THE INVENTION

The present invention relates to a method and an apparatus for the processing of photographic sheet material, in particular film or other photo-chemical material, particularly for developing exposed photographic material. In such a process the sheet material is brought into contact with aqueous processing liquids in a processing machine which comprises at least one wet processing station followed by a drying station in which wet sheet material comes into contact with heated drying air.

BACKGROUND OF THE INVENTION

A known apparatus for the processing of photographic sheet material comprises at least one wet processing station followed by a drying station in which wet sheet material comes into contact with heated drying air. A typical drying station comprises a drying chamber, a heater for heating air entering the drying chamber to a drying temperature, and a fan for recirculating a major proportion of drying air from the drying chamber through the heater directing the remaining proportion thereof through an exhaust outlet. Usually, a fresh air inlet is provided for supplying fresh air through the heater into the drying chamber.

In the drying of wet photographic sheet material at high throughput rates, such as may be necessary in automatic processing machines, it is important not to expose the sheet material to too high a temperature once the film has dried, otherwise dimensional instability may arise. An ideal drying environment is achieved using drying air which is not too hot and has a low relative humidity. However, if such conditions were to be employed in an apparatus such as described above, the drying chamber would need to be very large or the throughput of sheet material would have to be reduced.

SUMMARY OF THE INVENTION

It is an object of the present invention to provide a method and apparatus for drying sheet material in which the above mentioned problems can be overcome.

According to a first aspect of the invention, there is provided a method of drying wet photographic sheet material in a processing apparatus comprising at least one wet processing station followed by a drying station in which wet sheet material is brought into contact with heated drying air, characterised by the steps of:

feeding wet sheet material sequentially through upstream and downstream drying chambers:

heating air entering the downstream drying chamber to a downstream drying temperature:

recirculating a major proportion of drying air from the downstream drying chamber while taking in a minor proportion of fresh air through a fresh air inlet:

heating air entering the upstream drying chamber to an upstream drying temperature, higher than the downstream drying temperature:

recirculating a major proportion of drying air from the upstream drying chamber while taking in a minor proportion of air from the downstream drying chamber.

Preferably, the temperature of drying air in the upstream drying chamber is within the range 50° C. to 60° C., resulting in a (wet bulb) temperature lower than 40° C. on the wet sheet surface and the temperature of drying air in the downstream drying chamber is within the range 45° C. to 55° C. Ideally, the temperature of drying air in the upstream drying chamber is at least 5° C. higher than the wet bulb temperature of drying air in the downstream drying chamber.

From 70% to 80% of drying air from the downstream drying chamber may be recirculated and similarly for the upstream drying chamber.

In a preferred embodiment of the invention, the wet sheet material is fed through the upstream and downstream drying chambers at a linear speed of from 0.5 to 1.4 m/min, such as about 0.8 m/minute.

A drying assembly comprising a conveyor for material to be dried which travels in countercurrent to the drying air and which assembly comprises a succession of stages in each of which are provided means for heating and circulating the air, is known from GB 2 043 860 A. This known drying assembly is intended for drying tanned hides, more particularly for drying hides after their varnishing or podding, and forms thereby an art which is far remote from photography and is not very critical as to uniformity of drying.

In photography on The contrary, rapid and uniform drying is necessary to speed-up production and to ensure uniform density. It is well known that on some photographic materials densities increase slightly as the gelatin dries, others loose density, and slow drying may produce areas of uneven density. At the other hand, excessive drying temperatures cause weakening of the gelatin whereby the image quality is reduced, they can cause reticulation of the gelatin and still other defects.

Another disadvantage of a high drying temperature is that it can affect the dimensional stability of the support of the photographic material. This can have adverse consequences in the production of colour proofs and the like, wherein a colour proofing material is exposed in succession to four colour separation images, and wet processed and dried after each exposure. The correct register of the distinct separation images can become insufficient thereby so that the quality of the final colour proof can become unacceptable.

Drying at a temperature which is slightly lower in the downstream than in the upstream drying chamber(s) limits the risk of such dimensional changes.

As a matter of fact, the temperature in the first drying step can be relatively high in order to reduce the relative humidity, since the temperature of the photographic material, e.g. a colour proof, corresponds to the wet bulb temperature and thus is relative low (e.g. smaller than 40° C.). In the further drying step(s) the photographic material is almost dry and in consequence the drying temperature may not be too high. Yet such lower temperature produces a sufficient drying since a given rate of environmental air is heated which, in combination with the smaller moisture content of the photographic material, produces a small relative humidity.

The invention also provides an apparatus for the processing of photographic sheet material, the apparatus comprising at least one wet processing station followed by a drying station in which wet sheet material comes into contact with heated drying air, characterised in that the drying station comprises:

upstream and downstream drying chambers:

a downstream heater for heating air entering the downstream drying chamber to a downstream drying temperature:

a downstream fan recirculating a major proportion of drying air from the downstream drying chamber through the downstream heater while taking in a minor proportion of fresh air through a fresh air inlet:

an upstream heater for heating air entering the upstream drying chamber to an upstream drying temperature, higher than the downstream drying temperature:

an upstream fan for recirculating a major proportion of drying air from the upstream drying chamber through the upstream heater while taking in a minor proportion of air from the downstream drying chamber.

Usually, an exhaust outlet is provided through which the remaining portion of air from the upstream drying chamber leaves the drying station.

BRIEF DESCRIPTION OF THE DRAWINGS

The invention will now be further described, purely by way of example, by reference to the accompanying drawings in which.

DESCRIPTION OF THE PREFERRED EMBODIMENT

Figure 1:
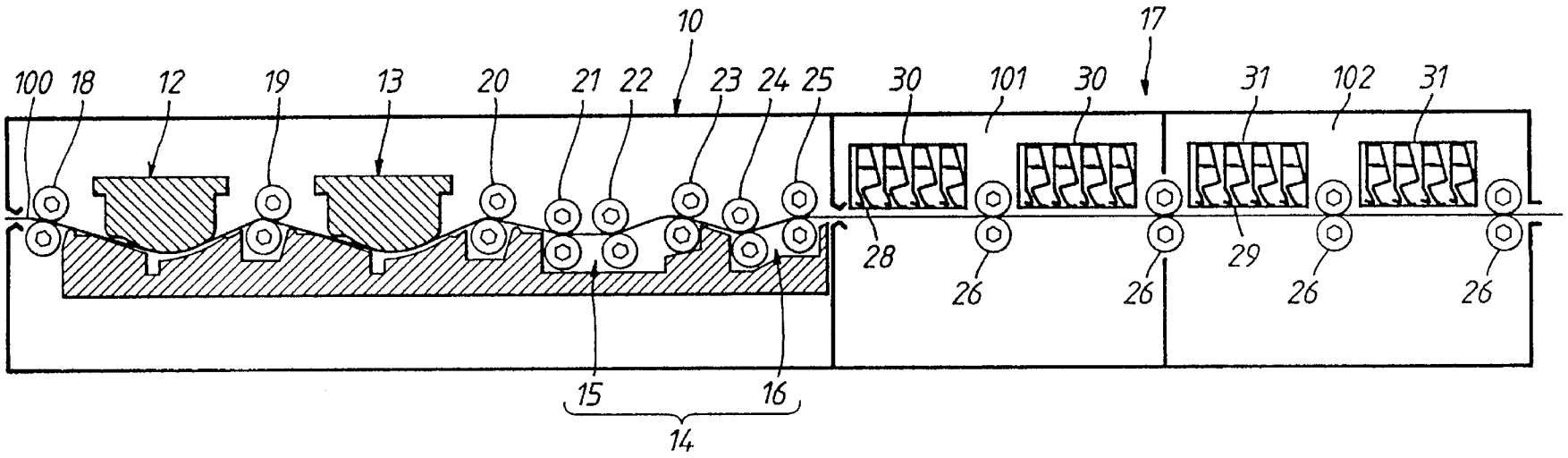
FIG. 1 is a diagrammatic longitudinal section of one embodiment of a processor for colour proof material.

With reference to FIG. 1 there is illustrated a longitudinal section through an apparatus 10 for processing exposed photographic sheet material, in particular lithographic printing plates, of the type described in EP-A-410500.

EP-A-410500 discloses an imaging element containing an aluminium support provided with in the order given an image receiving layer containing physical development nuclei, and a photosensitive layer containing a silver halide emulsion. In the document there is disclosed a diffusion transfer reversal process (hereinafter called "DTR process") for obtaining a lithographic printing plate in which said imaging element is image-wise exposed and subsequently developed using a developing liquid or activating liquid in the presence of a silver halide complexing agent. The imaging element is then guided through a diffusion transfer zone so that the silver halide complexes formed during the development step are allowed to diffuse into the image receiving layer where they are converted to silver. When the imaging element leaves The diffusion transfer zone a silver image is formed in the image receiving layer. The now useless photosensitive layer and optional other layers above the image receiving layer are then removed by guiding the imaging element through a washing and through a rinsing station. Finally the element now carrying a silver image on its surface is treated with a finishing liquid that contains a so called hydrophobizing agent for improving the hydrophobicity of the silver image.

Referring to FIG. 1, there is shown diagrammatically a processor 10 for the processing of an exposed photographic film for colour proofing, which comprises a developing station 12, a bleach-fixing station 13, a rinsing station 14 with a first section 15 and a second one 16, and a drying station 17.

A sheet of film 100 is transported at uniform velocity through the processor by means of suitably driven pressure roller pairs 18, 19, 20, 21, 22, 23, 24 and 25, the roller pairs for the dryer being indicated generally as 26. Each roller pair is mounted between two lateral walls (not shown) spaced in parallel relationship.

Rinsing station 14 comprises a first section 15 which is operative as a washing station, and a second station 16 which operates as a rinsing station.

Drier 17 has the form of a flat bed drier comprising a plurality of blower slots 28, 29 located above the film path. The drier 17 is subdivided into an upstream drying chamber 101 and a downstream drying chamber 102. The upstream blower slots 28 are provided with drying air from upstream manifolds 30 while the downstream blower slots 29 are provided with drying air from downstream manifolds 31. The manifolds 30 and 31 are not shown in FIG. 2 for the sake of clarity.

Figure 2:
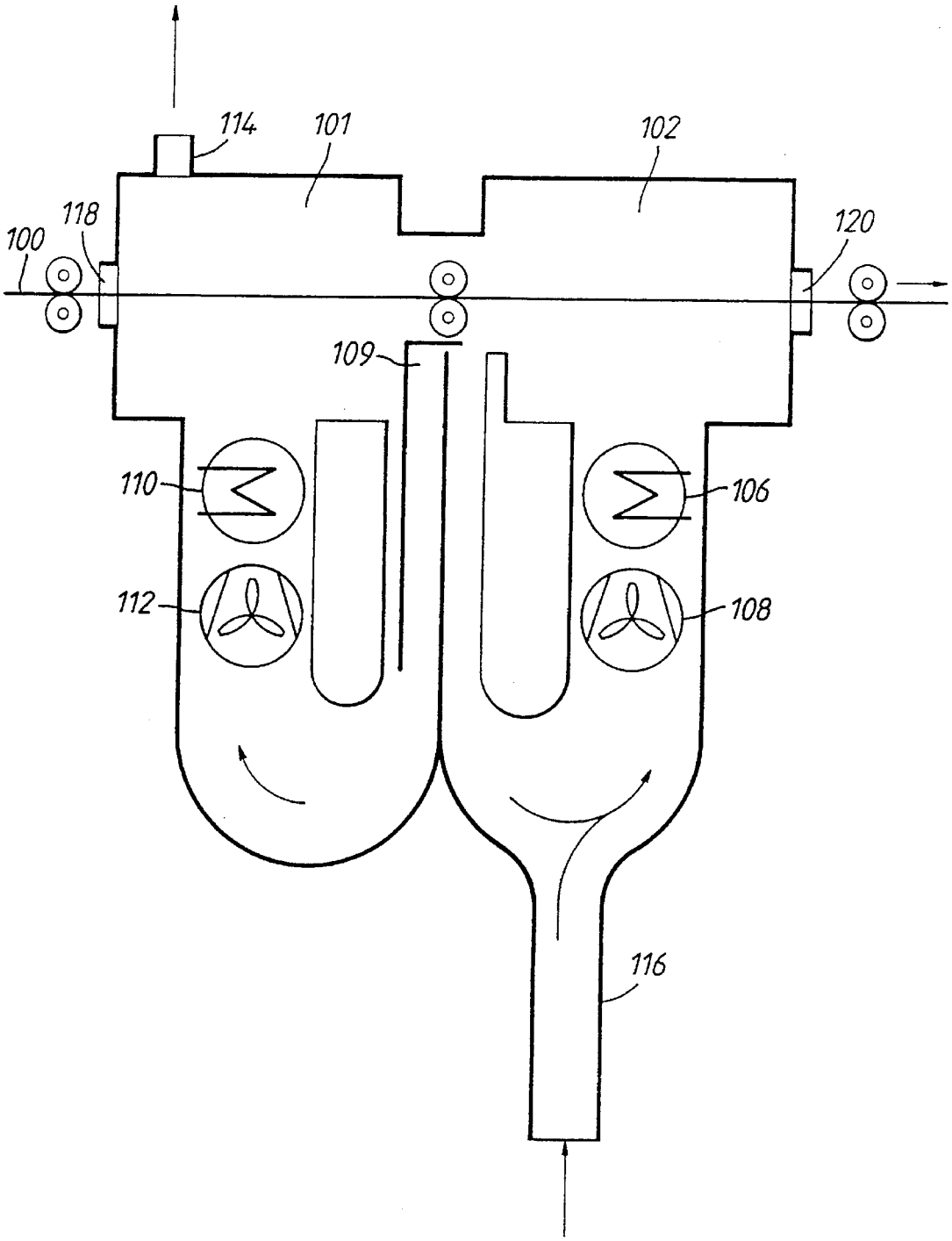
FIG. 2 is a schematic longitudinal cross-sectional view of the drier station of the apparatus shown in FIG. 1.

Referring to FIG. 2, the first or upstream drying chamber 101 and the second or downstream drying chamber 102 are shown, connected respectively to the upstream drying manifold 30 and the downstream drying manifold 31 shown in FIG. 1. The wet sheet material in the form of a film 100 is fed into the drying station through a film feed opening 118 and leaves by way of a film exit opening 120. The film passes through the drying chambers at a linear speed of about 0.8 m/minute.

A downstream heater 106 is provided for heating air entering the second drying chamber 102 to a downstream drying temperature $T_D$, of about 55° C., which depending on the moisture level of the wet sheet material 100 as it enters the second drying chamber 102 is equivalent to a wet bulb temperature of below 40° C. A downstream fan 108 recirculates a major proportion of drying air amounting to about 75% thereof from the second drying chamber 102 through the downstream heater 106 while taking in a minor proportion of fresh air through a fresh air inlet 116.

An upstream heater 110 heats air entering the first drying chamber 101 to an upstream drying temperature $T_U$ of about 60° C., that is higher than the downstream drying temperature $T_D$. The upstream drying temperature $T_U$, depending on the moisture level of the wet sheet material 100 as it enters the first drying chamber 101, is equivalent to a wet bulb temperature of below 40° C. The absolute humidity in the first drying chamber 101 will be higher than in the second drying chamber 102 since the wet film 100 enters through the first dryer chamber 101.

An upstream fan 112 recirculates a major proportion of drying air amounting to about 75% thereof from the first drying chamber 101 through the upstream heater 110 while taking in a minor proportion of air from the second drying chamber 102 via a passage 109. Air leaves the first drying chamber 101 through an exhaust outlet 114.

The heated air which is passed into the second drying chamber 102 consists partly of outside air and partly of air which has been recirculated from the second drying chamber 102. It is important to ensure that cold outside air does not enter the first and second drying chambers with the film. This is ensured in that the air pressure inside the drying chambers 101,102 is higher than the ambient air pressure. Since the absolute humidity is lower in the second drying chamber 102 than in the first drying chamber 101. The drying air is heated by the upstream heater 110 to reach approximately a comparable relative humidity. The recirculation of heated drying air reduces energy consumption, while the intake of a proportion of outside fresh air enables a lower relative humidity to be achieved.

The first drying chamber is fed with air that does not include any fresh air, but since the temperature in the first drying chamber is higher, the relative humidity will drop again. The recirculation of drying air through the first drying chamber 101 leads to a saving of energy.

The wet film 100 thus first enters a zone with a rather low relative humidity at a reasonably high temperature. Since The surface of the film is still wet, the temperature of this surface will not exceed the wet bulb temperature. Where the temperature in the first drying chamber is about 60° C., the wet bulb temperature will be at most 38° C. This supposes however that the film is not completely dry as it leaves the first drying chamber, for if it were over heating of the film in The second drying chamber 102 might occur leading to dimensional instability. The speed of drying will depend a upon number of factors including the nature of the film material and an operator can optimise the process by adjustment of the drying temperature or, less preferably, throughput speed. In The second drying chamber 102 the temperature is lower, but The relative humidity is also very low. Therefore the conditions for obtaining completely dry film are favourable.

We claim:

1. A method of drying wet photographic sheet material in a processing apparatus comprising at least one wet processing station (12, 13, 14, 15, 16) followed by a drying station (17) in which wet sheet material (100) is brought into contact with heated drying air, characterised by the steps of:

feeding wet sheet material (100) sequentially through upstream and downstream drying chambers (101, 102);

heating air entering the downstream drying chamber (102) to a downstream drying temperature;

recirculating a major proportion of drying air through the downstream drying chamber (102) while taking in a minor proportion of fresh air through a fresh air inlet (116);

heating air entering the upstream drying chamber (101) to an upstream drying temperature, higher than the downstream drying temperature;

recirculating a major proportion of drying air from the upstream drying chamber (101) while taking in a minor proportion of air from the downstream drying chamber (102).

2. A method according to claim 1, wherein the temperature of drying air in the upstream drying chamber (101) is within the range 50° C. to 60° C. and the temperature of drying air in the downstream drying chamber (102) is within the range 45° C. to 55° C.

3. A method according to claim 1 or 2, wherein the temperature of drying air in the upstream drying chamber (101) is at least 5° C. higher than the temperature of drying air in the downstream drying chamber (102).

4. A method according to any preceding claim, wherein from 70% to 80% of drying air from the downstream drying chamber (102) is recirculated.

5. A method according to any preceding claim, wherein from 70% to 80% of drying air from the upstream drying chamber (101) is recirculated.

6. A method according to any preceding claim, wherein the wet sheet material (100) is fed through the upstream and downstream drying chambers (101, 102) at a linear speed of from 0.5 to 1.4 m/min.

7. An apparatus for the processing of photographic sheet material, the apparatus comprising at least one wet processing station (12, 13, 14, 15, 16) followed by a drying station (17) in which wet sheet material (100) comes into contact with heated drying air, characterised in that the drying station (17) comprises:

upstream and downstream drying chambers (101, 102);

a downstream heater (106) for heating air entering the downstream drying chamber (102) to a downstream drying temperature;

a downstream fan (108) recirculating a major proportion of drying air from the downstream drying chamber (102) through the downstream heater (106) while taking in a minor proportion of fresh air through a fresh air inlet (116);

an upstream heater (110) for heating air entering the upstream drying chamber (101) to an upstream drying temperature, higher than the downstream drying temperature;

an upstream fan (112) for recirculating a major proportion of drying air from the upstream drying chamber (101) through the upstream heater (110) while taking in a minor proportion of air from the downstream drying chamber (102).

8. An apparatus according to claim 7, wherein an exhaust outlet (114) is provided through which the remaining portion of air from the upstream drying chamber (101) leaves the drying station (17).

* * * * *